US005296457A

United States Patent [19]

Cooke et al.

[11] Patent Number: 5,296,457

[45] Date of Patent: Mar. 22, 1994

[54] CLAMSHELL MICROWAVE CAVITIES HAVING A SUPERCONDUCTIVE COATING

[75] Inventors: D. Wayne Cooke; Paul N. Arendt, both of Los Alamos, N. Mex.; Helmut Piel, Wuppertal, Fed. Rep. of Germany

[73] Assignee: The Regents of the University of California, Oakland, Calif.

[21] Appl. No.: 868,150

[22] Filed: Apr. 14, 1992

Related U.S. Application Data

[63] Continuation-in-part of Ser. No. 856,428, Mar. 23, 1992, abandoned.

[51] Int. Cl.[5] ..... H01P 1/16; H01P 7/06; H01B 12/06

[52] U.S. Cl. ..... 505/1; 333/99.5; 333/228; 505/700; 505/701; 505/866

[58] Field of Search ..... 333/99 S, 227, 228, 333/219; 505/1, 700, 701, 866

[56] References Cited

U.S. PATENT DOCUMENTS

| | | | |
|---|---|---|---|
| 297,656 | 5/1943 | Jaumann | 333/227 |
| 3,458,808 | 7/1969 | Agdur | 333/227 X |
| 4,439,747 | 3/1984 | Kreinheader et al. | 333/228 X |
| 4,673,894 | 6/1987 | Rogers | 331/96 |
| 4,918,049 | 4/1990 | Cohn et al. | 505/1 |
| 5,030,914 | 7/1991 | Jasper | 333/995 |

OTHER PUBLICATIONS

Momose et al; "Fabrication and RF Surface Resistance of Superconducting Lead Cavity by a Press Forming Technique"; *Electronics & Communication in Japan;* vol. 63-B, No. 4; Apr. 1980; pp. 58-64.

Furuya et al; "First Results on a 500 Mhz Superconducting Test Cavity for TRISTAN" *Japanese Journal of Applied Physics;* vol. 20, No. 2; Feb. 1981, pp. L145-L148.

Turneare and Viet; "Superconducting Nb $TM_{010}$ Mode electron-beam welded cavities"; *Applied Physics Letters;* vol. 16, NO. 9; May 1, 1970; pp. 333-335.

*Primary Examiner*—Benny T. Lee

*Attorney, Agent, or Firm*—Bruce H. Cottrell

[57] ABSTRACT

A microwave cavity including a pair of opposing clamshell halves, such halves comprised of a metal selected from the group consisting of silver, copper, or a silver-based alloy, wherein the cavity is further characterized as exhibiting a dominant $TE_{011}$ mode is provided together with an embodiment wherein the interior concave surfaces of the clamshell halves are coated with a superconductive material. In the case of copper clamshell halves, the microwave cavity has a Q-value of about $1.2\times10^5$ as measured at a temperature of 10K and a frequency of 10 GHz.

17 Claims, 2 Drawing Sheets

CLAMSHELL MICROWAVE CAVITIES HAVING A SUPERCONDUCTIVE COATING

This invention is the result of a contract with the Department of Energy (Contract No. W-7405-ENG-36).

This is a continuation-in-part of application Ser. No. 856,428, filed Mar. 23, 1992, now abandoned.

FIELD OF THE INVENTION

The present invention relates to the field of microwave cavities and to microwave cavities including a coating of a superconductive material, e.g., a high temperature superconductive material.

BACKGROUND OF THE INVENTION

Conventional right-circular cylindrical resonant cavities have several electromagnetic modes. One mode of typical interest is the $TE_{011}$ mode. This mode has the electric field flowing circumferentially, which implies that no electric currents cross a joint if, for example, the end walls are removed. This type of electric flow is important as it allows the replacement of the end walls with other materials and measures surface resistance without concern about accounting for losses due to electric currents crossing a joint. Unfortunately, the $TE_{011}$ mode is degenerate with a $TM_{111}$ mode, which does in fact have currents that flow across joints. For right circular cylinders these two modes can be separated with a mode separator, i.e., a notch in the bottom of the cavity. Such a notch perturbs the two modes such that the $TE_{011}$ mode is separated in frequency from the $TM_{111}$ mode. This result is easily seen on the transmission curve of the cavity. While such a system has the desired concomitant circumferential electric field, the design, in particular the dimensions, of a right-circular cylindrical cavity is generally unsuitable for coating with superconductive materials, especially high temperature superconductive materials. It has become highly desirable to coat microwave cavities with superconductive materials, especially high temperature superconductive materials, so as to increase the quality factor, i.e., the Q-value, of the cavity as well as the performance of the cavity.

Accordingly, it is an object of this invention to provide a microwave cavity having a geometry adapted for subsequent coating by a superconductive material, preferably a high temperature superconductive material.

Another object of this invention is to provide a microwave cavity having a geometry design wherein the $TE_{011}$ and $TM_{111}$ modes are separated without the need for a mode separator.

It is a still further object of this invention to provide a microwave cavity having its interior surfaces coated with a superconductive material, preferably a high temperature superconductive material.

SUMMARY OF THE INVENTION

To achieve the foregoing and other objects, and in accordance with the purposes of the present invention, as embodied and broadly described herein, the present invention provides a microwave cavity including a pair of opposing clamshell halves, the halves are comprised of a metal selected from the group consisting of silver, copper, or a silver-based alloy, wherein said clamshell halves further include opposing coupling ports and said cavity is further characterized as exhibiting a dominant $TE_{011}$ mode and separated $TE_{011}$ and $TM_{111}$ modes. In one embodiment of the invention, the clamshell halves are of dimensions adapted to yield a frequency of about 10 GHz. The microwave cavity, in the embodiment where the clamshell halves are of copper, has a Q-value of about $1.2\times10^5$ as measured at 10K and a frequency of 10 GHz. In another embodiment, the interior concave surfaces of the clamshell halves are coated with a superconductive material, e.g., a high temperature superconductive material.

DETAILED DESCRIPTION OF THE INVENTION

The present invention concerns assemblies with novel geometries for forming microwave cavities, such cavities useful in both low power applications and in high power applications.

A particular geometry for a microwave cavity will typically give that microwave cavity a unique and distinct Q value or a measure of the energy stored in that microwave cavity. Generally, $Q=E/W=G/R_s$ where G is the geometric factor of the cavity, $R_s$ is the surface resistance of the cavity wall, E is the total energy stored and W is the energy loss per RF cycle. Since Q increases as $R_s$ decreases, decreasing the surface resistance of the cavity walls by application of a superconductive material is desirable.

Figure 1:
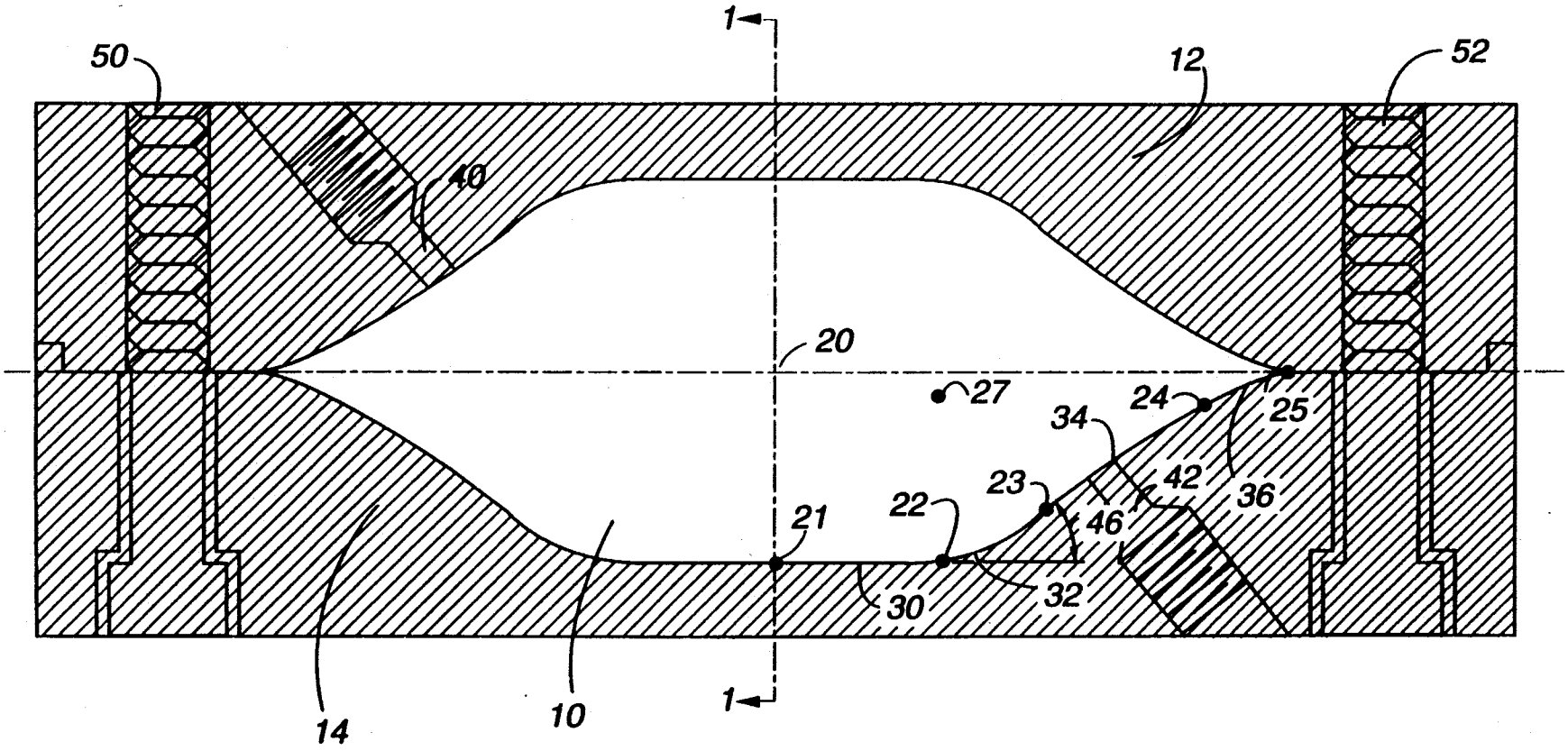
FIG. 1 shows a cross-sectional view illustrating the microwave cavity in the present invention and the particular geometry of the assembly.

In microwave cavities of the present invention, the microwave cavity is formed by joining together two opposing clamshell halves. The clamshell halves are joined with their concave surfaces opposite thereby forming the interior cavity. The shallow, conical-like surface allows direct deposition of, e.g., high temperature superconductive materials. Such deposition is further facilitated by the ability to separate the clamshell halves and coat each interior surface separately. One embodiment of a microwave cavity of the present invention is shown in FIG. 1 wherein the cavity 10 is defined by the walls of clamshell halves 12 and 14. The concave walls of each clamshell half generally have a large radius of curvature so that the wall surface has a gradual curvature. The specific dimensions of this cavity yield a geometric factor of about 699 ohms and a dominant $TE_{011}$ mode operating at a frequency of 9.97118 GHz. For a cavity formed from copper, a Q-value of about 120,000 was measured at 10K. Generally, the particular dimensions of the assembly yielding the microwave cavity can be varied slightly with only minor changes resulting in the properties and performance of the microwave cavity, e.g., if every dimension were increased by about 10 percent, there would be a decrease in frequency and some change in Q-value. Similarly, if the angles, e.g., angle 26 were changed then the other dimensions could be changed to yield a similar microwave cavity.

The clamshell halves can be generally formed from metals such as silver, copper, or a silver-based alloy, e.g., Consil, a tradename of Handy and Harmon, Co., a silver alloy of about 99.5 percent by weight silver, 0.25 percent by weight nickel and 0.25 percent by weight magnesium, generally available from Handy and Harmon. Preferably, the clamshell halves are formed from a silver-based alloy. The silver substrate surfaces allow c-axis growth of the high temperature superconductive materials.

The microwave cavity of the present invention is further characterized as exhibiting a dominant $TE_{011}$ mode and separated $TE_{011}$ and $TM_{111}$ modes. The microwave cavity can be still further characterized in the case of clamshell halves formed of copper by a value of Q generally about $1.2\times10^5$ at a temperature of 10K and a frequency of 10 GHz. In operation of the cavity, the geometry of the two clamshell halves eliminates or minimizes electric currents from passing across the joint between the two halves thereby avoiding microwave losses at the joint or interface of the two halves.

The superconductive material can be either a low temperature superconductive material or can be a high temperature superconducting material. Low temperature superconductor materials can include, e.g., niobium, lead, niobium-tin and the like. High temperature superconductive materials are generally those materials that become superconductive at temperatures above about 30K. Exemplary of high temperature superconductive materials are the high temperature superconductive materials including, e.g., bismuth-based superconductive materials such as a bismuth-lead-strontium-calcium-copper oxide, e.g., $(Bi_{2-x}Pb_x)Sr_2Ca_2Cu_3O_x$ or a bismuth-strontium-calcium-copper oxide, yttrium-based superconductive materials such as a yttrium-barium-copper oxide, e.g., $YBa_2Cu_3O_x$ or a yttrium-barium-calcium-copper oxide, and thallium-based superconductive materials such as a thallium-barium-calcium-copper oxide, e.g., $Tl_2Ba_2Ca_2Cu_3O_x$. The high temperature superconductive material can also be a barium-potassium-bismuth oxide and the like. Other well-known high temperature superconductive materials may also be employed for coating the microwave cavity walls.

In coating the microwave cavity surfaces with a high temperature superconductive material such as, e.g., a thallium-barium-calcium-copper oxide, a deposition process such as magnetron sputtering, chemical vapor deposition, electron-beam co-evaporation or pulsed laser deposition can be employed, with magnetron sputtering being especially preferred because of its ability to uniformly coat large, irregular shaped surface areas. Preferably, the superconductive coating will have the c-axis oriented perpendicularly to the clamshell interior surfaces. In general, such magnetron sputtering can be conducted as described by Arendt et al. in Science and Technology of Thin Film Superconductors, R. D. McConnell and S. A. Wolf, Editors, pages 185-191 (Plenum Publishing 1989), such description hereby incorporated by reference.

The superconductive material is generally applied as a thin coating upon the cavity walls. Generally, the superconductive material will be applied in thicknesses from about 0.5 microns to about 10 microns.

Referring to the figures, FIG. 1 shows clamshell halves 12 and 14, having opposing concave surfaces. In one preferred embodiment for a 10 GHz microwave cavity, the dimensions of the clamshells halves used in forming the cavity 10 can be determined off of centerline 1—1. Cavity wall section 30 is the portion between points 21 and 22 and is 0.373 inches in length. Point 21 is on centerline 1—1 and point 22 is then 0.373 inches from centerline 1—1. Cavity wall section 32 is the portion between points 22 and 23 and is defined by the arc drawn with a 0.45 inch radius from a line through point 22 and parallel to centerline 1—1. Cavity wall section 34 is the portion between points 23 and 24 and is 0.373 inches in length. Point 23 is 0.628 inches from centerline 1—1. Point 24 is 1.143 inches from centerline 1—1 and point 25 is 1.398 inches from centerline 1—1. Cavity wall section 36 is the portion between points 24 and 25 and is defined by the arc drawn with a 0.45 inch radius from a line through point 25 and parallel to centerline 1—1. The angle 26 between a line defined by points 21 and 22 and a line defined by points 23 and 24 is 34.51°. The depth of the clamshell halves, i.e., from the jointline, the line through points 25 and 20 (point 20 being the centerpoint of the cavity), to cavity wall section 30 is 0.513 inches. Coupling ports 40 and 42 are placed in an opposing configuration for entering energy into the cavity via a coaxial cable. Such ports can be of any necessary dimension to accommodate a low power feed such as from a coaxial cable or can be adapted for a high power feed such as from a suitable waveguide. Typically a coaxial cable will be attached by threads within coupling ports 40 and 42. Clamshell halves are secured in opposing arrangement by a securing means, e.g., screws or bolts 50 and 52. The clamshell halves are shaped similar to a pie pan with the dimensions shown going from point 21 along the cavity wall to point 25 extending circularly around the clamshell half, e.g., by a 360° rotation of the cavity wall from point 21 to point 25 about centerline 1—1.

Figure 2:
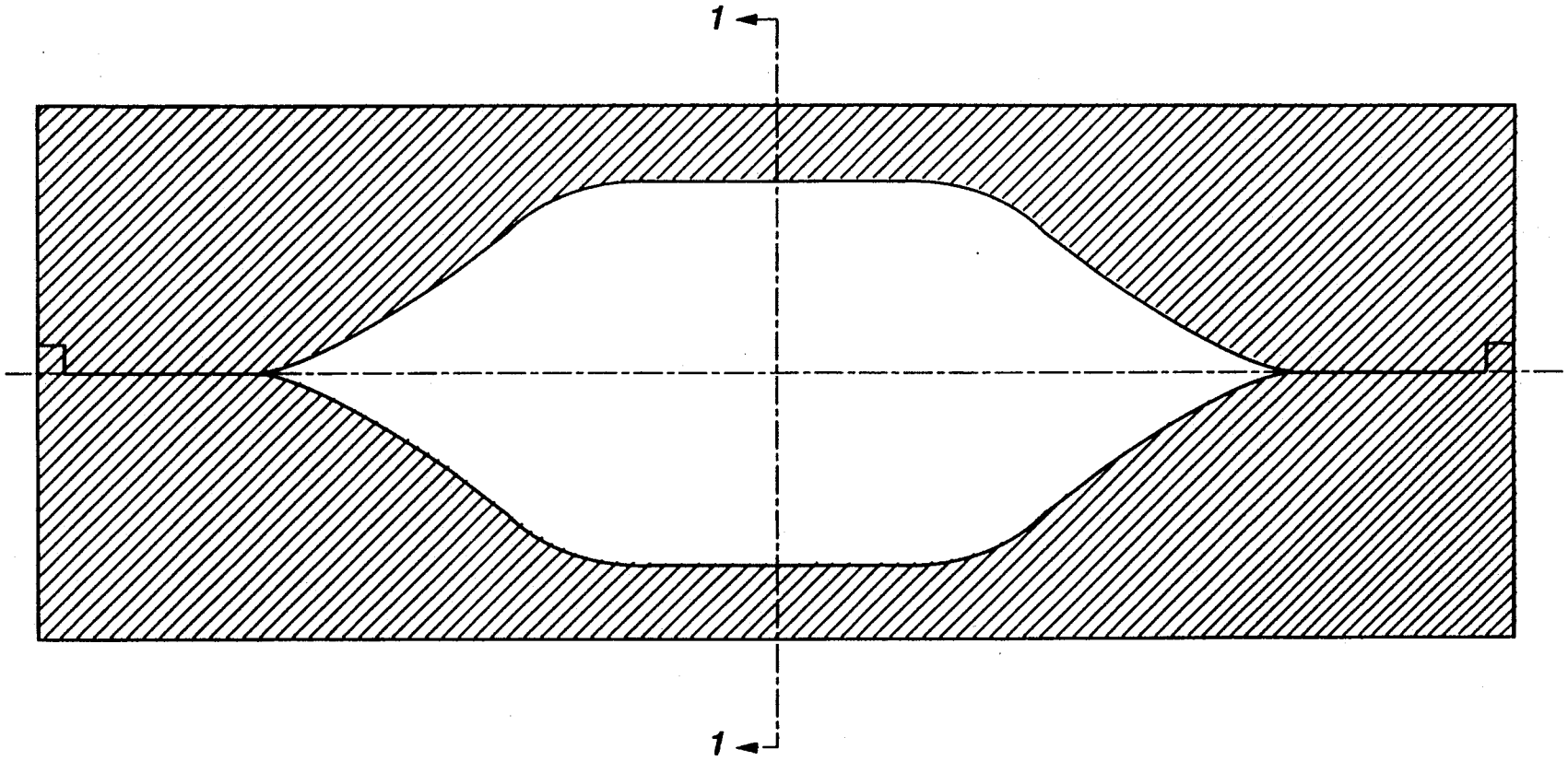
FIG. 2 shows a second cross-sectional view of the microwave cavity taken along centerline 1—1 of FIG. 1., FIG. 2 being a view perpendicular to FIG. 1 through centerline 1—1.

Thus, FIG. 2. shows a second cross-sectional view of the clamshell cavity of the present invention as seen along a plane perpendicular to the plane shown in FIG. 1, each cross-section taken through line 1—1. As seen in FIG. 2, the basic configuration of the cavity remains the same through any plane rotated about centerline 1—1, with the cross-sectional view in FIG. 2 simply not slicing through the coupling ports or the bolt holes.

Microwave cavities in accordance with the present invention can be used in many electronics applications such as radar receivers and satellite communications, and may be used in particle beam accelerators.

The present invention is more particularly described in the following examples which are intended as illustrative only, since numerous modifications and variations will be apparent to those skilled in the art.

EXAMPLE 1

A microwave cavity was fabricated from a silver-based alloy in accordance with FIG. 1 and FIG. 2 as follows. A rough approximation of the dimensions of a desired clamshell type geometry was initially selected and those dimensions together with a geometric factor of about 699 ohms were inserted into the computer software program of the name URMEL-T. URMEL-T and the URMEL-T user guide are obtainable from U. Laustroer, U. van Rienen and T. Weiland at DESY M-87-03 in Hamburg, Germany. The URMEL-T program calculated the precise dimensions necessary for the microwave cavity to have a frequency of about 10 GHz and at a geometric factor of 699 with the desired dominant $TE_{011}$ mode. The cavity was then formed using the precise dimensions generated from the program. Dimensions of the clamshell halves used in forming the cavity are terminable off of centerline 1—1. Cavity wall section 30 is the portion between points 21 and 22 and is 0.373 inches in length. Point 21 is on centerline 1—1 and point 22 is then 0.373 inches from centerline 1—1. Cavity wall section 32 is the portion between points 22 and 23 and is defined by the arc drawn with a 0.45 inch radius from a line through point 27 and parallel to centerline 1—1. Cavity wall section 34 is the portion between points 23 and 24 and is 0.373 inches in length. Point 23 is 0.628 inches from centerline 1—1. Point 24 is 1.143 inches from centerline 1—1 and point 25 is 1.398 inches from centerline 1—1. Cavity wall section 36 is the portion between points 24 and 25 and is defined oy the arc drawn with a 0.45 inch radius from a line through point 25 and parallel to centerline 1—1. The angle 26 between a line defined by points 21 and 22 and a line defined by points 23 and 24 is 34.51°. The depth of the clamshell halves, i.e., from the jointline, the line through points 25 and 20 (point 20 being the centerpoint of the cavity), to cavity wall section 30 is 0.513 inches. Coupling ports 40 and 42 are placed in an opposing configuration for entering energy into the cavity via a coaxial cable. Such ports can be of any necessary dimension to accommodate a low power feed such as from a coaxial cable or can be adapted for a high power feed such as from a suitable waveguide. Typically a coaxial cable will be attached by threads within coupling slots 40 and 42. The individual clamshell halves thus formed were placed in opposition and the resultant cavity had the desired properties including a dominant $TE_{011}$ mode, separate $TE_{011}$ and $TM_{111}$ modes, a frequency of about 10 GHz and in a fabrication out of copper a Q-value for the resultant cavity of about $1.2\times10^5$ at 10K and 10 GHz.

EXAMPLE 2

A microwave cavity coated with superconductive material is prepared as follows. Initially, the concave surfaces of the cavity are coated with a precursor film of barium-calcium-copper oxide. The metal oxides are deposited from a 4-inch diameter planar target of $Ba_2Ca_2Cu_3O_x$ by radio frequency magnetron sputter deposition. The center of the clamshell cavity is slightly offset from the center of the planar target for best coating results. The cavity is rotated beneath the sputter target during deposition to ensure uniformity in the film composition and thickness. The resultant precursor film is then converted to a high temperature superconducting film by annealing the film in an oven at elevated temperatures of from about 840° C. to about 880° C. The oven atmosphere is composed of oxygen and thallium oxide sublimated from a small amount, about 20 to 30 milligrams, of solid thallium oxide placed in a pan within the oven. During annealing at the elevated temperatures, thallium oxide is diffused into the precursor film and the final superconducting phases are formed. The resultant superconductive film is of thallium-barium-calcium-copper oxide.

Although the present invention has been described with reference to specific details, it is not intended that such details should be regarded as limitations upon the scope of the invention, except as and to the extent that they are included in the accompanying claims.

What is claimed is:

1. A high power microwave cavity comprising a pair of opposing operatively connected clamshell halves oriented with respective inner facing concave surfaces, said halves comprised of a metal selected from the group consisting of silver, copper, and silver-based alloys, wherein said clamshell halves each further includes an operatively connected coupling port, said coupling ports being arranged in an opposing orientation to each other, said cavity is further characterized as exhibiting a dominant $TE_{011}$ mode and a $TM_{111}$ mode separated from said $TE_{011}$ mode and wherein at least one of said coupling ports is characterized as a waveguide port for insertion of a waveguide.

2. A microwave cavity comprising a pair of opposing operatively connected clamshell halves oriented with respective inner facing concave surfaces, said halves comprised of a metal selected from the group consisting of silver, copper and silver-based alloys, wherein said clamshell halves each further includes an operatively connected coupling port, said coupling ports being arranged in an opposing orientation to each other said cavity is further characterized as exhibiting a dominant $TE_{011}$ mode and a $TM_{111}$ mode separated from said $TE_{011}$ mode, and said clamshell halves are of dimensions yielding a frequency of about 10 GHz and a geometric factor of about 699 ohms.

3. The microwave cavity of claim 2 wherein the cavity is comprised of copper and has a Q-value of about $1.2\times10^{-5}$ at a temperature of 10K and a frequency of 10 GHz.

4. The microwave cavity of claim 2 wherein said pair of opposing clamshell halves include a thin coating of a superconductive material upon the concave surfaces of the halves.

5. The microwave cavity of claim 2 wherein said pair of opposing clamshell halves include a thin coating of a high temperature superconductive material upon the concave surfaces of the halves.

6. The microwave cavity of claim 2 wherein the clamshell halves are comprised of silver.

7. The microwave cavity of claim 6 wherein said pair of opposing halves include a thin coating of a high temperature superconductive material upon the concave surfaces of the halves.

8. The microwave cavity of claim 2 wherein the clamshell halves are comprised of a silver-based alloy.

9. The microwave cavity of claim 8 wherein said pair of opposing halves include a thin coating of a high temperature superconductive material upon the concave surfaces of the halves.

10. A high power microwave cavity comprising a pair of opposing operatively connected clamshell halves oriented with respective inner facing concave surfaces, said halves comprised of a metal selected from the group consisting of silver, copper, and silver-based alloys, wherein said clamshell halves each further includes an operatively connected coupling port, said coupling ports being arranged in an opposing orientation to each other, said cavity is further characterized as exhibiting a dominant $TE_{011}$ mode and a $TM_{111}$ mode separated from said $TE_{011}$ mode, at least one of said coupling ports is characterized as a waveguide port for insertion of a waveguide, and said clamshell halves are of dimensions yielding a frequency of about 10 GHz and a geometric factor of about 699 ohms.

11. The microwave cavity of claim 10 wherein said pair of opposing clamshell halves include a thin coating of a high temperature superconductive material upon the concave surfaces of the halves.

12. The microwave cavity of claim 10 wherein the cavity is comprised of copper and has a Q-value of about $1.2\times10^{-5}$ at a temperature of 10K and a frequency of 10 GHz.

13. The microwave cavity of claim 10 wherein said pair of opposing clamshell halves include a thin coating of a superconductive material upon the concave surfaces of the halves.

14. The microwave cavity of claim 10 wherein the clamshell halves are comprised of a silver-based alloy.

15. The microwave cavity of claim 14 wherein said pair of opposing halves include a thin coating of a high temperature superconductive material upon the concave surfaces of the halves.

16. The microwave cavity of claim 10 wherein the clamshell halves are comprised of silver.

17. The microwave cavity of claim 16 wherein said pair of oposing halves include a thin coating of a high temperature superconductive material upon the concave surfaces of the halves.

* * * * *